US011834806B2

(12) United States Patent
Tizzoni

(10) Patent No.: US 11,834,806 B2
(45) Date of Patent: Dec. 5, 2023

(54) METHOD AND KIT FOR MANUFACTURING FOUNDATIONS FOR UPRIGHTS BY USING SHEETS EMBEDDED BY VIBRATION OR BY PERCUSSION

(71) Applicant: FONSIDER S.R.L., Porcari (IT)

(72) Inventor: Giampaolo Tizzoni, Forte dei Marmi (IT)

(73) Assignee: FONSIDER S.R.L., Porcari (IT)

( * ) Notice: Subject to any disclaimer, the term of this patent is extended or adjusted under 35 U.S.C. 154(b) by 135 days.

(21) Appl. No.: 17/312,474

(22) PCT Filed: Dec. 19, 2019

(86) PCT No.: PCT/IB2019/061076
§ 371 (c)(1),
(2) Date: Jun. 10, 2021

(87) PCT Pub. No.: WO2020/128935
PCT Pub. Date: Jun. 25, 2020

(65) Prior Publication Data

US 2022/0056658 A1 Feb. 24, 2022

(30) Foreign Application Priority Data

Dec. 20, 2018 (IT) ..... 102018000020314

(51) Int. Cl.
*E02D 27/42* (2006.01)
*E02D 5/04* (2006.01)
(Continued)

(52) U.S. Cl.
CPC ..... *E02D 27/42* (2013.01); *E02D 5/04* (2013.01); *E02D 7/18* (2013.01); *E02D 13/04* (2013.01);
(Continued)

(58) Field of Classification Search
CPC .. E02D 27/42; E02D 5/04; E02D 7/18; E02D 13/04; E02D 2300/0032; E02D 2600/20
See application file for complete search history.

(56) References Cited

U.S. PATENT DOCUMENTS 3,342,444 A * 9/1967 Nelson ..... E04H 12/2215 52/165
3,614,142 A * 10/1971 Muller ..... E04H 17/22 405/250
(Continued)

FOREIGN PATENT DOCUMENTS

DE 2725057 A1 12/1978
EP 0453252 A1 10/1991
(Continued)

OTHER PUBLICATIONS

International Search Report, dated May 4, 2020, for corresponding International Patent Application No. PCT/IB2019/061076.

*Primary Examiner* — Kyle Armstrong
(74) *Attorney, Agent, or Firm* — AMSTER, ROTHSTEIN & EBENSTEIN LLP

(57) ABSTRACT

The present invention relates to a method for manufacturing foundations for uprights (1) by using metal sheets (2) embedded by vibration or by percussion comprising the steps of: a. arranging at least two sheets (2), each sheet (2) being provided with position adjustment means with respect to a connection element (5) between the sheet (2) itself and a connector (3) between the sheet (2) and upright (1); b. arranging a connector (3) between the sheet (2) and upright (1), adapted to be integrally connected to said upright (1) and provided with position adjustment means with respect to a connection element (5) between the sheet (2) and the connector (3) itself; c. arranging at least one connection element (5) between each sheet (2) and the connector (3),
(Continued)

each connection element (5) being provided with first position adjustment means, adapted to adjust the position thereof with respect to the sheet (2) and second position adjustment means, adapted to adjust the position thereof with respect to the connector (3); d. arranging a centering system (4) for the sheets (2), which can be associated operationally with an embedding machine; e. embedding said sheets (2) into the ground by vibro-embedding or by percussion, with the aid of the centering system (4); f. positioning the connector (3) in the design position, adjusting the relative position between: —each sheet (2) and each connection element (5) by means of said position adjustment means of the sheet (2) and said first position adjustment means of the connection element (5); —each connection element (5) and the connector (3) by means of said position adjustment means of the connector (3) and said second position adjustment means of the connection element (5); g. locking such positions. The present invention also relates to a corresponding kit and to a centering system for sheets 2 adapted to be vibro-embedded or embedded by percussion.

14 Claims, 7 Drawing Sheets

(51) Int. Cl.
*E02D 7/18* (2006.01)
*E02D 13/04* (2006.01)

(52) U.S. Cl.
CPC .. *E02D 2300/0032* (2013.01); *E02D 2600/20* (2013.01)

(56) References Cited

U.S. PATENT DOCUMENTS

| | | | | |
|---|---|---|---|---|
| 4,252,472 | A * | 2/1981 | Moraly | E04H 17/263 52/165 |
| 4,588,545 | A * | 5/1986 | Kauffman | D06N 7/0013 264/52 |
| 5,899,030 | A * | 5/1999 | Barefield | E04H 12/2215 403/374.1 |
| 10,287,742 | B2 * | 5/2019 | Tappe | E02D 27/32 |
| 10,422,097 | B2 * | 9/2019 | Reinert | E02D 7/00 |
| 2013/0322970 | A1 * | 12/2013 | Tappe | E02D 27/08 405/229 |
| 2017/0009419 | A1 * | 1/2017 | Reinert | E04H 12/2215 |

FOREIGN PATENT DOCUMENTS

| | | | |
|---|---|---|---|
| JP | S60151939 | U | 10/1985 |
| WO | 2016/160002 | A1 | 10/2016 |

* cited by examiner

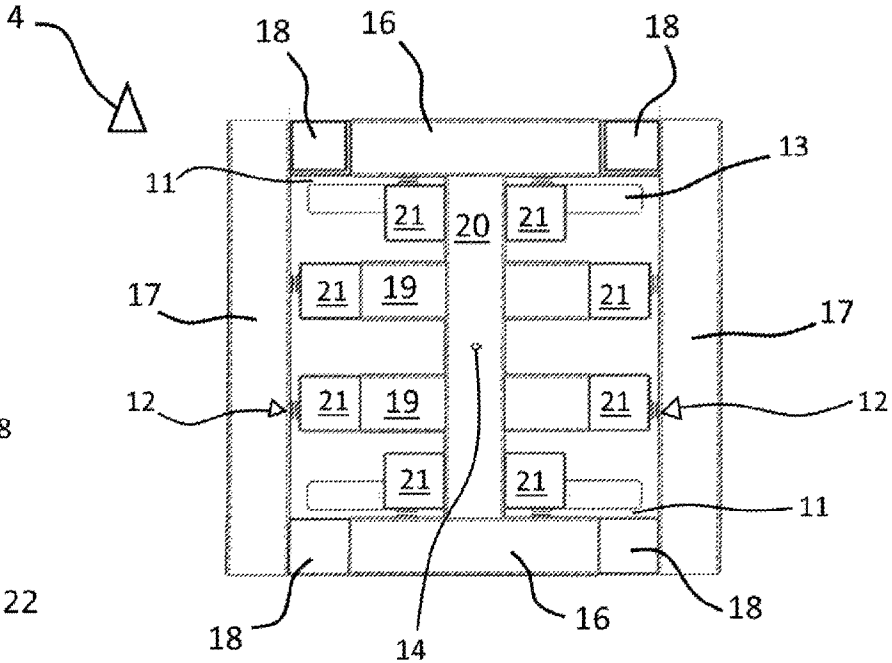
Fig. 2b
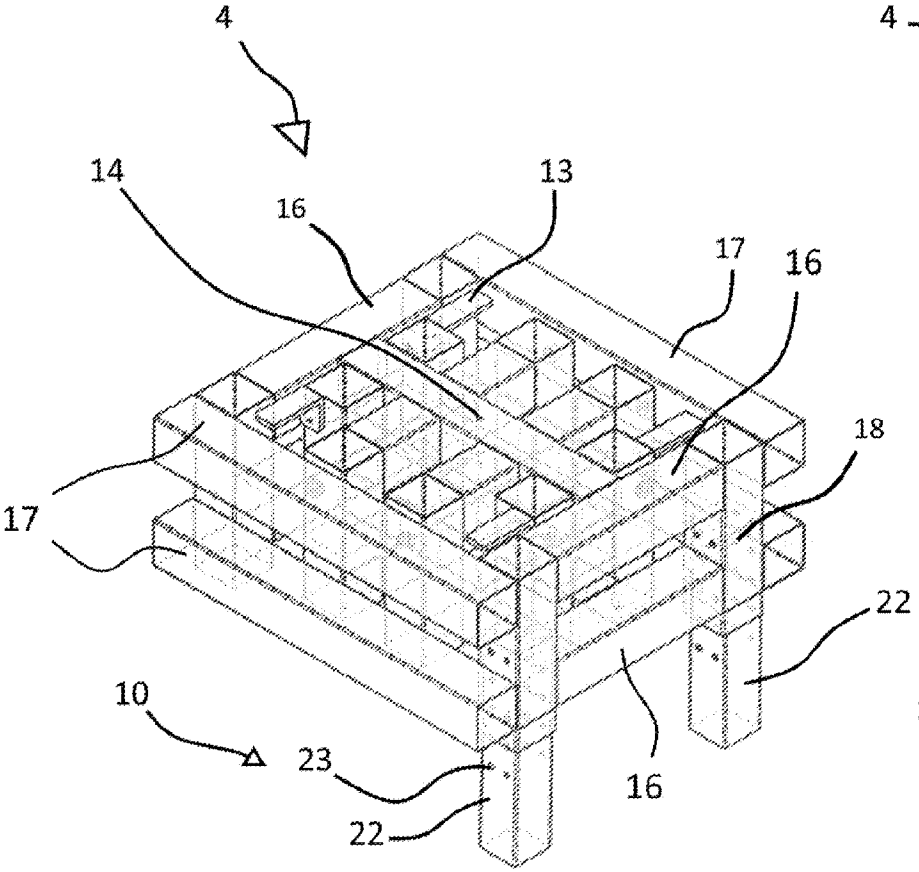
Fig. 2a
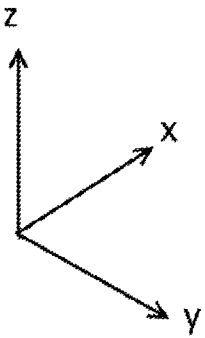

METHOD AND KIT FOR MANUFACTURING FOUNDATIONS FOR UPRIGHTS BY USING SHEETS EMBEDDED BY VIBRATION OR BY PERCUSSION

CROSS REFERENCE TO RELATED APPLICATIONS

This application is a national phase of PCT application No. PCT/IB2019/061076, filed Dec. 19, 2019, which claims priority to IT patent application No. 102018000020314, filed Dec. 20, 2018, all of which are incorporated herein by reference thereto.

FIELD OF THE INVENTION

The present invention relates to a method and to a kit for manufacturing foundations for uprights by means of sheets embedded by vibration or by percussion. In particular, the present invention relates to a method and to a kit for manufacturing foundations for metal uprights by using vibro-embedded sheets or sheets embedded by percussion.

BACKGROUND ART

The use of embedded sheets as sheet piles, i.e., with a hydraulic function in support of riverbanks or levees and/or with the aim of supporting the ground, for example, to bear excavation walls or in the construction of harbors, is currently known. They are usually placed side by side to form a continuous vertical wall, called sheet piling, and are embedded by vibro-embedding or by percussion. Generally, such sheets are in the form of rolled profiles and are widely employed for the aforementioned uses, since they are cost-effective and particularly simple and fast to embed.

However, at present, the employment thereof is limited to a restricted field of application, since the techniques used for the embedding thereof, if on one hand make the employment thereof particularly advantageous, on the other hand, limit the application thereof to fields which do not require particular precision in positioning the sheets themselves.

In fact, vibro-embedding and embedding by percussion do not guarantee accuracy in the positioning of the sheets due to the nature of the latter and because of the variability of the grounds in which they are embedded (some types of ground require greater embedding forces with respect to others). In particular, such embedding techniques produce deviations from the design conditions, both in terms of position and orientation, which can reach values of tens of cm and of 10/15 degrees of rotation respectively.

The owner of the present application has therefore felt the need to develop a method and a kit which extend the field of application of the embedded sheets also to cases in which high positioning accuracy is required, in particular, for the construction of foundations for uprights.

The latter, in fact, are currently made at least partially in concrete, with the obvious drawbacks that derive therefrom, including long installation times, expensive set-up operations for the foundation site and high extension of the excavations. Plinths, inverted beams and slabs are some examples of conventional foundations for uprights.

On the other hand, to support certain uprights, such as columns of buildings, or poles, such as light towers, a plurality of sheets need to be embedded. Thereby, the positioning error of a single sheet is added to the relative positioning error of the sheets which form the structure supporting the upright. Not being capable of obtaining positioning accuracy of one sheet with respect to the other, it is in fact difficult, if not impossible, to manufacture a fitting element or connector between the various embedded sheets and the upright.

Furthermore, by using such sheets as foundations, the sheets embedding errors would be reproduced in the uprights anchored to the sheets (by means of a fitting element or connector), making a correct installation of the relative above-ground structures, which must necessarily comply with the design measures, extremely difficult and, in some cases impossible. For this reason, to date, the embedded sheets are not used for manufacturing foundations for uprights.

In fact, compliance with the design conditions, in terms of position and orientation of the support uprights, is extremely relevant. Especially for the installation of above-ground structures of the continuous and in-line type, such as, for example, barriers, partition walls, curtain walls, fences, columns for civil or industrial buildings and the like. In these cases, in fact, minimal deviations from the design conditions can prevent following the layout line provided for the above-ground structure and/or a correct fastening of elements of the above-ground structure to the respective support uprights. Also for manufacturing punctual structures, such as lighting poles, light towers, poles for the transport of electricity, telecommunication poles, etc., the use of two or more embedded sheets is necessary, whereby the relative positioning error between the sheets, with respect to the design data, makes it difficult, and sometimes impossible, to create a fitting element or connector between all the embedded sheets and the upright and/or above-ground pole.

For these reasons, as mentioned above, the use of embedded sheets is, to date, limited to the employment in sheet piles.

SUMMARY OF THE INVENTION

It is therefore an object of the present invention to provide a method and a kit which allow the use of sheets embedded by vibration or by percussion for manufacturing foundations for metal uprights.

It is a further object of the present invention to provide a method and a kit for manufacturing foundations for uprights which are reliable and cost-effective.

It is another object of the present invention to provide a method and a kit for manufacturing foundations for uprights which reduce times, costs and extension, and therefore inconveniences, linked to the presence of a construction site.

These and further objects are achieved by means of a method set forth in the claims.

In particular, such objects are achieved by means of a method for installing foundations for uprights by using metal sheets embedded by vibration or by percussion comprising the steps of:

a. arranging at least two sheets, each sheet being provided with position adjustment means with respect to a connection element between the sheet itself and a fitting element (connector) between the sheet and upright;
b. arranging a fitting element between the sheet and upright, adapted to be integrally connected to said upright and provided with position adjustment means with respect to a connection element between the sheet and the fitting element itself;
c. arranging at least one connection element between each sheet and the fitting element, each connection element being provided with first position adjustment means, adapted to adjust the position thereof with respect to the sheet and second position adjustment means, adapted to adjust the position thereof with respect to the fitting element;

d. arranging a centering system for the sheets, which can be associated operationally with an embedding machine;

e. embedding said sheets into the ground by vibro-embedding or by percussion, with the aid of the centering system;

f. positioning the fitting element in the design position, adjusting the relative position between:

each sheet and each connection element by means of said position adjustment means of the sheet and said first position adjustment means of the connection element;

each connection element and the fitting element by means of said position adjustment means of the connector and said second position adjustment means of the connection element;

g. locking such positions.

The combination of the steps of such method allows to achieve the aforementioned objects. In fact, by providing a first step of controlling the errors within predetermined values, by arranging a suitable centering system, and a subsequent step of adjusting the relative positions, by arranging the aforementioned position adjustment means, it allows to obtain a high upright positioning precision. In particular, such method allows such an adjustment of the position of the fitting element allowing to position the upright in the design position and therefore allowing the use of sheets embedded by vibration or percussion also for manufacturing foundations for uprights. It should be noted that arranging a centering system alone would not be sufficient to achieve the required accuracy, since it should leave enough space for the sheets to vibrate and then be embedded into the ground. Even providing only relative adjustment steps between the various parts would not be sufficient since, if the errors are not previously checked within predetermined intervals, it would not be sufficient and, in some cases it would not even be possible, to make small adjustments that further reduce or completely eliminate errors, allowing a substantially perfect positioning of the upright.

Therefore, it is the particular combination of the claimed steps which achieves the objects of the present invention.

Such method is cost-effective, since it involves the actuation of simple steps with the aid of simple components, but at the same time is reliable since, as mentioned, it allows to reduce the sheets embedding errors within predetermined intervals so as to subsequently eliminate the fitting element (connector) positioning errors and position the upright in the design position thereof.

In other words, the sheets embedded with such method constitute solid, precise and reliable foundations, on which it is possible to build any type of structure.

By using sheets embedded by vibration or percussion as foundations for uprights, it is also possible to avoid conventional concrete foundations, thereby avoiding large excavations and expensive foundation site preparation operations, including construction and laying of reinforcement cages, concrete pouring, etc. The claimed method therefore allows to reduce the area and duration of the construction site required for manufacturing foundations and therefore to reduce the inconvenience and costs associated with the manufacturing of the foundations and of the corresponding above-ground structure.

A further advantage of the claimed method is linked to the fact that embedded sheets, unlike concrete foundations, are easily removable and reusable in the future.

Preferably, step f) of adjusting the relative positions is actuated by means of the following sub steps:

f'. adjusting and locking the relative position between one sheet and a connection element along a first and a second axis, orthogonal to each other;

f". adjusting and locking the relative position between said first connection element and the fitting element along said first or said second axis and along a third axis, orthogonal to the first and to the second axis;

f'". repeating steps f' and f" for each connection element and for each sheet.

Thereby, it is possible to adjust the errors along three directions, independently of one another, in favor of a more flexible and more accurate adjustment.

In accordance with preferred embodiments, step f) is adapted to ensure that the positioning errors of the upright are substantially equal to zero with respect to the design data.

Preferably, step e) of embedding the sheets in the ground is actuated by means of the following sub steps:

e1. positioning the centering system on the ground;

e2. placing the centering system in a horizontal position by means of appropriate height adjustment means;

e3. inserting the sheets in appropriate guides of the centering system so that they are in the design theoretical embedding position;

e4. creating a space along at least one axis transverse to the sheet so that the sheet can vibrate or incline during the successive embedding step;

e5. embedding the sheets in the ground by means of vibro-embedding or embedding by percussion until reaching a predetermined embedding height;

e6. removing the centering system.

Thereby, the method is effective, simple and fast.

Advantageously, step e1) of positioning the centering system on the ground is actuated by positioning a central hole of the centering system at a predetermined design point. Thereby, the step of positioning the centering system is further fast and simple.

The same objects achieved by the method claim, are also achieved by means of a kit for manufacturing foundations for uprights by using sheets embedded by vibration or by percussion comprising:

at least two sheets, each sheet being provided with position adjustment means with respect to a connection element between the sheet itself and a fitting element between the sheet and upright;

a fitting element (connector) between the sheet and upright, adapted to be integrally connected to said upright and provided with position adjustment means with respect to a connection element between the sheet and the fitting element itself;

at least one connection element between each sheet and the fitting element, each connection element being provided with first position adjustment means, adapted to adjust the position thereof with respect to the sheet and second position adjustment means, adapted to adjust the position thereof with respect to the fitting element;

a centering system for the sheets, which can be associated operationally with an embedding machine.

Such kit, comprising a centering system, achieves a control of the sheets embedding errors within tolerable limits, i.e., within values which can be subsequently eliminated by means of the adjustment means so that the fitting element, and consequently the upright, are in the design position.

Therefore, by virtue of the combination of the claimed features, the kit of the present invention allows the use of sheets embedded by vibration or percussion for manufacturing foundations for metal uprights, with all the aforementioned advantages arising. Furthermore, it is cost-effective since it comprises simple parts and, at the same time, it is reliable.

Furthermore, such a kit allows to manufacture foundations for uprights with reduced times, costs and extension, and therefore with reduced inconveniences, linked to the presence of a construction site.

Finally, the presence of a connection element with the aforementioned features allows the errors to be adjusted along three directions independently, allowing the connection between the sheets and fitting element. In fact, since the fitting element is a single element and since it has to be connected to sheets which have relative errors—whether they are displaced or rotated—independent from sheet to sheet, it would be difficult to connect it to the different sheets. The features of the connector allow instead such connection.

The position adjustment means of the connection element, together with the further position adjustment means of sheet and fitting element, allow the position to be adjusted along three directions (x, y and z), independently of one another. Preferably, said centering system is adapted to ensure that, on completion of embedding, the positioning errors of each sheet are lower than, or equal to the following values: $\Delta x=70$ mm; $\Delta y=70$ mm; $\Delta z=70$ mm; $\Delta\varphi=5°$, with respect to the design data. Wherein $\Delta x$ is the deviation from the design position along the axis x; $\Delta y$ is the deviation along the axis y; $\Delta z$ is the deviation along the axis z; $\Delta\varphi$ is the angular deviation with respect to such axes, wherein the axes x, y and z are shown in FIGS. 2*a* and 7*a*. Obviously, the deviation is intended as an absolute value, i.e., it can be positive or negative with respect to the design data.

Even more preferably, $\Delta x=30$ mm; $\Delta y=30$ mm; $\Delta z=30$ mm; $\Delta\varphi=5°$.

In accordance with preferred embodiments, the centering system comprises at least one of:

- height adjustment means adapted for the horizontal positioning of the centering system itself;
- guides adapted for the correct positioning of the sheets in the embedding position;
- removable elements adapted to create, by means of the removal thereof, a space along at least one axis transverse to the sheet so that the sheet can vibrate or incline at the time of embedding;
- at least one abutment element for each sheet adapted to adjust the embedding height of the sheet itself;
- a central hole, adapted to identify a predetermined design point, for the positioning of the centering system itself.

Advantageously, said centering system comprises a reticular frame formed by a plurality of metal profiles extending along three directions perpendicular to one another. The metal profiles are, in fact, cost-effective and resistant.

Preferably, said reticular frame comprises:

an outer structure comprising:

at least two first outer profiles, parallel to each other and extending along a first direction x; at least two second outer profiles, parallel to each other and extending along a second direction y, orthogonal to the first direction x; and four third outer profiles, parallel to one another and extending along a third direction z, orthogonal to the first two directions;

and an internal structure comprising:

at least one first internal profile, parallel to the first outer profiles; at least a second internal profile, parallel to the second outer profiles, said at least one second internal profile being rigidly connected to said first outer profiles at the ends thereof; and eight third internal profiles, parallel to the third outer profiles.

Such structure is particularly simple and reliable.

Preferably, between the outer structure and the internal structure, spaces are obtained acting as a guide for the insertion of the sheets in the centering system. Such guides are simple and cost-effective.

In accordance with preferred embodiments, inside each of said spaces, at least one removable element is placed for each sheet, which is adapted to lock the sheets in the design theoretical embedding position and to be removed at the time of embedding, so as to allow the vibration or the inclination during the embedding operations. They are simple and effective.

Advantageously, the profiles are of the tubular type, so as to be light and stable. The height adjustment means preferably comprise further profiles, telescopically coupled to the third internal profiles and/or to the third outer profiles. Thereby, the operation of adjusting the height of the centering element is simple. It is in fact sufficient to slide one or more further profiles with respect to the third profiles and lock them with locking means to adjust the height.

Advantageously, the position adjustment means of the sheets with respect to the connection element and/or the position adjustment means of the fitting element with respect to the connection element and/or the first position adjustment means of the connection element and/or the second position adjustment means of the connection element comprise slotted holes. The latter are particularly simple and cost-effective to make.

The connection element preferably comprises a connection bracket of the angular, right angle type. It is simple and reliable.

It is a further object of the present invention to provide a centering system which achieves the control of the embedding errors within predetermined limits.

Such object is achieved by means of a centering system according to the claims. In particular, such object is achieved by means of a centering system for sheets, adapted to be embedded by vibration or percussion, comprising:

- height adjustment means adapted for the horizontal positioning thereof;
- guides adapted for the correct positioning of the sheets in the design theoretical embedding position;
- removable elements, placed inside said guides, adapted to create a space along at least one axis transverse to the sheet so that the sheet can vibrate or incline during the embedding operations.

Such a system allows a correct positioning of the sheets before the embedding, by virtue of the presence of guides and removable elements; and effective embedding by virtue of the presence of removable elements which, once removed, allow the vibration of the sheets; and a control of the positioning error of the sheets within predetermined limits by virtue of the presence of guides of a predefined size. It therefore allows to extend the field of application of the sheets embedded by vibration or percussion also to applications which require greater positioning accuracy.

Such system is preferably adapted to ensure that, on completion of embedding, the positioning errors of each sheet are lower than or equal to the following values: Δx=70 mm; Δy=70 mm; Δz=70 mm; Δφ=5°, with respect to the design data. Even more preferably, Δx=30 mm; Δy=30 mm; Δz=30 mm; Δφ=5°.

In accordance with preferred embodiments, said centering system further comprises at least one of:

- at least one abutment element for each sheet adapted to adjust the embedding height of the sheet itself;
- a central hole, adapted to identify a predetermined design point, for the positioning of the centering system itself;
- means for the operational association with an embedding machine by vibration or by percussion.

In this context, the wording "integrally connected" or "integrally anchored" indicates that the connection in question makes two parts integral, i.e., it makes them a single piece.

Furthermore, in the present description and in the subsequent claims, the term "upright" indicates a vertical support structure, such as a steel column with H, T, L, I, C section, a steel pole with a circular or elliptical section or structures of a different type, as known in the sector.

In the present context, when referring to the extension of a slotted hole, it should be intended as the slotting extension and not the depth of the hole.

Finally, in this context, the wording "design position" or "design data" refers to the positions and the theoretical design data, i.e., to the positions in which the deviations with respect to the design indications are substantially zero.

BRIEF DESCRIPTION OF THE DRAWINGS

Further features and advantages of the invention will become apparent from the following detailed description of some preferred, but not exclusive, embodiments of the method and kit for manufacturing foundations for uprights by using sheets embedded by vibration or by percussion, and of the centering system, shown only by way of indicative and non-limitative example, with the support of the accompanying drawings, in which:

FIG. 2*a* shows a perspective view of a centering system according to a preferred embodiment of the present invention;

FIG. 2*b* shows a plan view of FIG. 2*a;*

The present invention will be described below in greater detail by means of a detailed description of embodiments given by way of explanation and not by way of limitation.

DETAILED DESCRIPTION

Figure 3C:
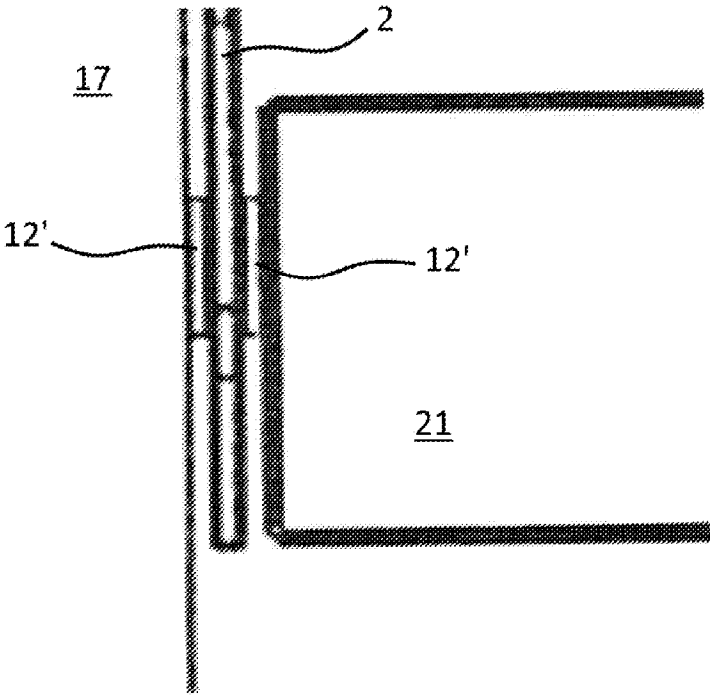
FIG. 3*c* shows an enlarged detail of FIG. 3*b;*
Figure 3B:
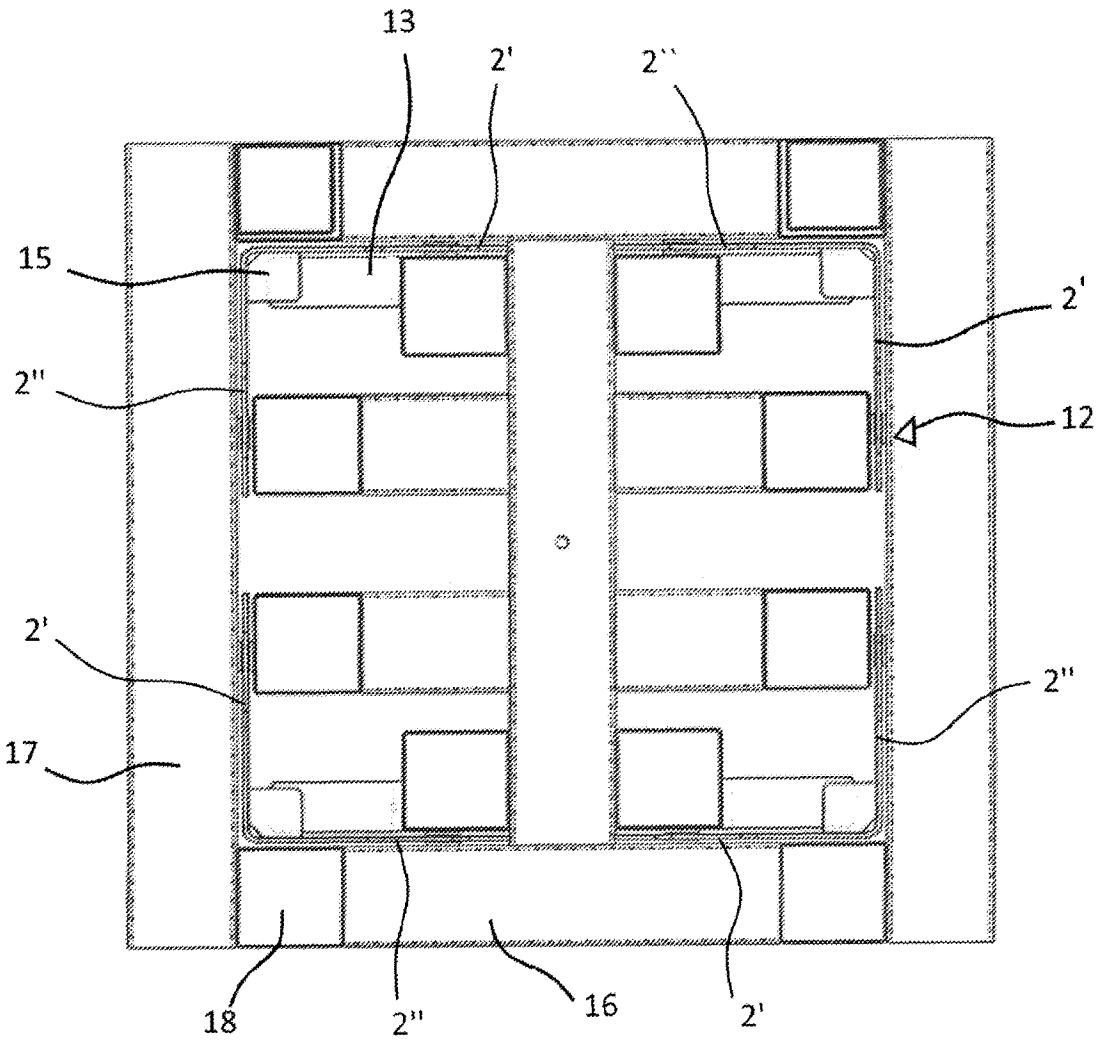
FIG. 3*b* shows a plan view of FIG. 3*a;*
Figure 3A:
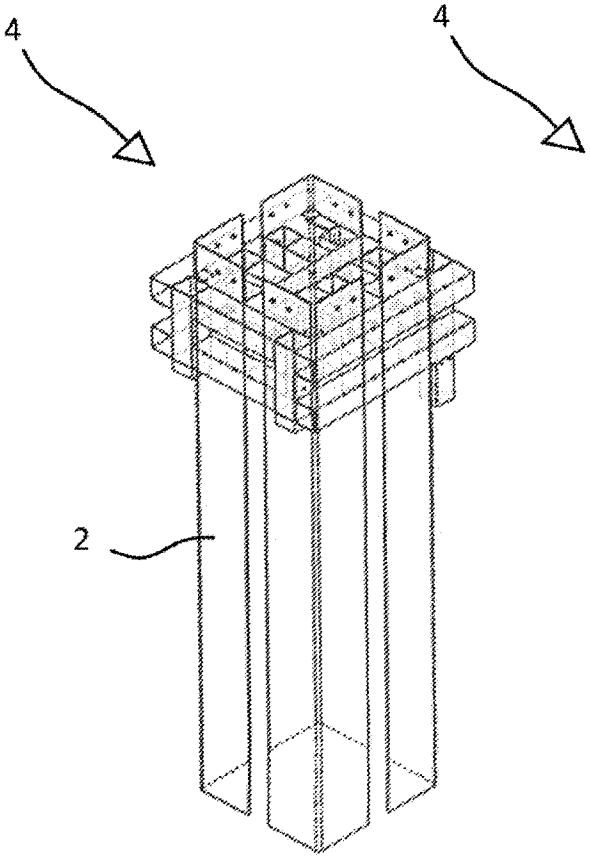
FIG. 3*a* shows a diagrammatic perspective view of the sheets of FIGS. 1*a* and 1*b* inserted in the centering system of FIGS. 2*a* and 2*b*, during a step of the method of the present invention.
Figure 4:
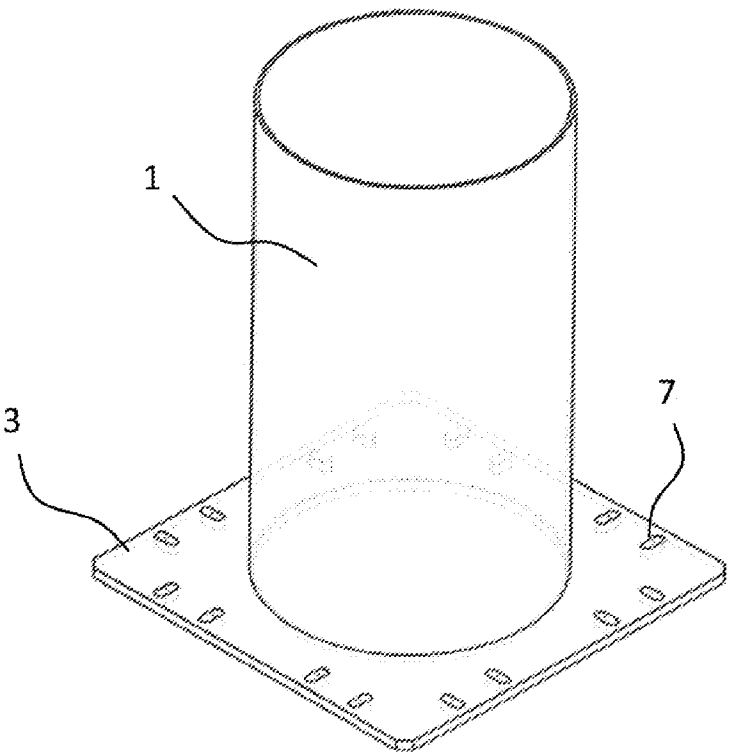
FIG. 4 shows a perspective view of a fitting element (connector) of a kit according to a preferred embodiment of the present invention, anchored to a structure/upright.

With reference to FIGS. 1-7*b*, reference numeral 1 identifies an upright of the known type, in steel or other type of metal alloy or metal. It can be of any known shape, such as, for example, cylindrical, as shown in FIG. 4, parallelepiped, a truncated cone, with a T-section, a double T-section, an I-section, an L-section, or a C-section, depending on the uses for which it is intended. The upright 1 can be intended to support buildings, noise barriers, partition walls or curtain walls of buildings, fences, lighting poles, light towers, poles for the transport of electricity, towers for mobile phone repeaters, poles for road signs, poles for supporting weather stations, columns for civil or industrial buildings.

Figure 1B:
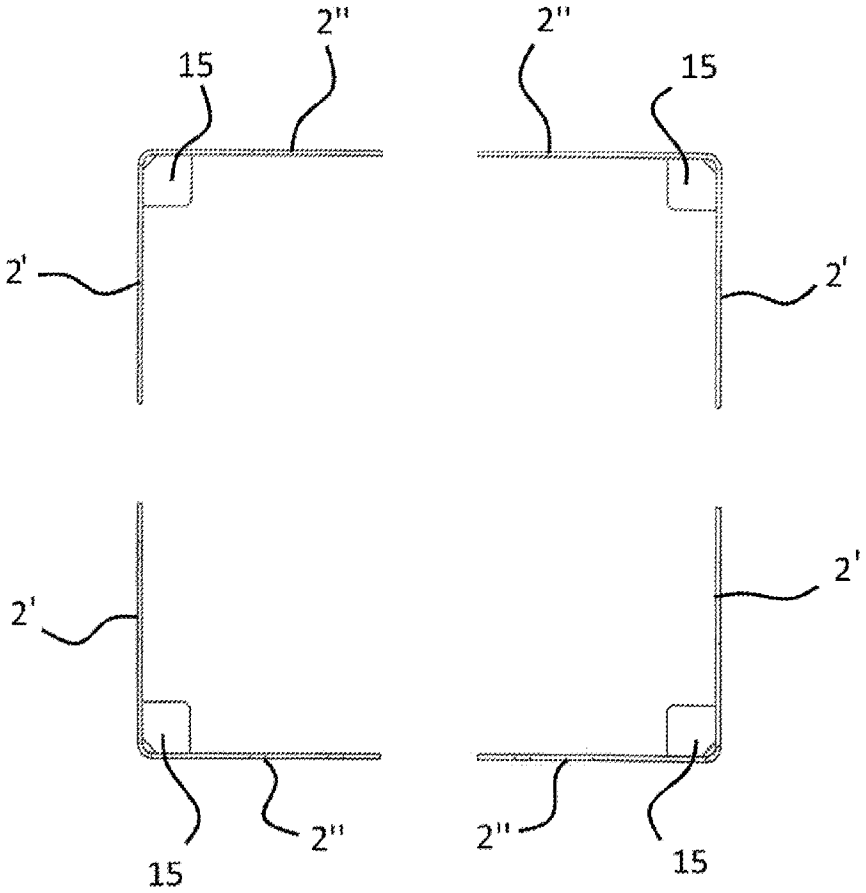
FIG. 1*b* shows a plan view of FIG. 1*a;*
Figure 1A:
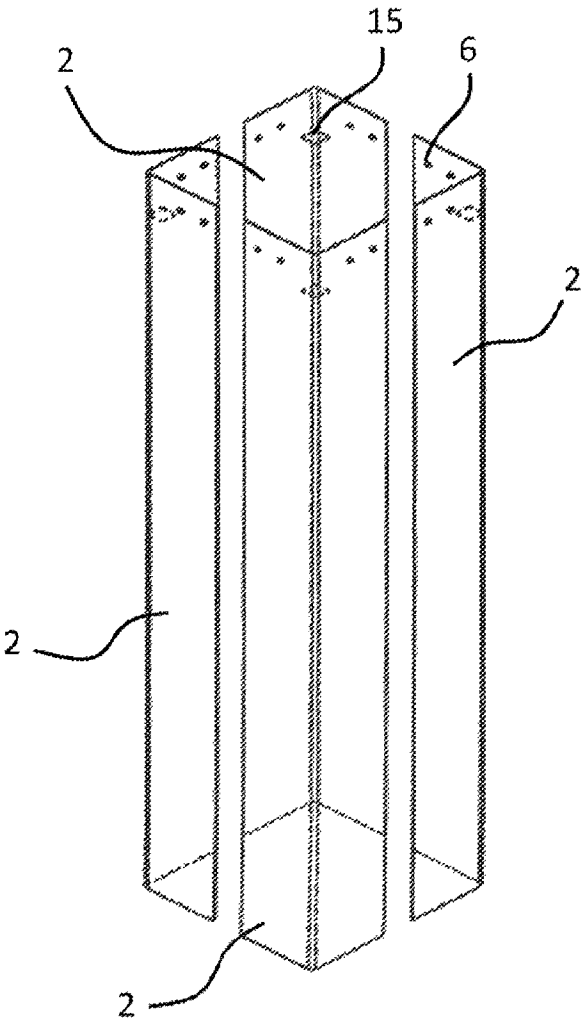
FIG. 1*a* shows a perspective view of a set of four sheets of a kit according to a preferred embodiment of the present invention, adapted to be embedded by vibration or percussion for manufacturing foundations for uprights according to the method of the present invention.

Instead, reference numeral 2 indicates a sheet intended to act as a foundation for an upright 1, by virtue of the present invention. The sheet 2 preferably has an L-section with the two sides equal, as shown in the Figures. In this case, it is possible to identify a first portion of sheet 2' and a second portion of sheet 2", orthogonal to each other, as shown in FIG. 1*b*. However, the sheet 2 may have any shape, for example, it may have an L-section with one of the two sides greater with respect to the other, or it may have a section having two right angles, for example C-shaped, etc. The sheet 2 is preferably made of steel, or another type of metal alloy or metal.

Reference numeral 3 is instead used to indicate a fitting element (also referred to as connector) between an upright 1 and one or more sheets 2. The connector or fitting element 3, in the preferred embodiments shown in the Figures, is in the form of a square plate, but may have different shapes. It is adapted to be integrally connected to said upright 1 and is preferably made of steel, or another type of metal alloy, or metal.

The present invention relates to a kit for manufacturing foundations for uprights 1, by using sheets 2. Such kit comprises at least two sheets 2. In the preferred embodiments shown in the Figures, there are four such sheets 2. Each sheet 2 is provided with position adjustment means with respect to a connection element 5 between the sheet 2 itself and a connector 3. Preferably, said position adjustment means comprise first slotted holes 6, in a number of at least two for each sheet 2. In the embodiments shown in the Figures, the first slotted holes 6 are four for each sheet, i.e., two obtained in the first portion of sheet 2' and two obtained in the second portion of sheet 2", at the ends thereof. They are slotted in the longitudinal direction with respect to the sheet 2, i.e., they extend vertically on completion of embedding.

With reference to the Cartesian reference system in FIG. 2*a*, they extend along the axis z. However, they may be slotted in a different direction, as explained below. Preferably, each sheet 2 is provided with at least one plate 15, or equivalent means, positioned transversely with respect to the sheet 2 itself, or extending in the plane xy of the aforesaid reference system. Such plate 15 has a dual function: firstly, it serves to adjust the embedding height of the sheet 2, abutting against a corresponding abutment element 13 (FIG.

3*b*) placed in a centering system 4, as described below. Secondly, such plate 15, together with the plates 15 of the further sheets 2, serves as a support base for a connector 3, during the step of anchoring the sheets 2 to the connector 3, as better explained below.

By virtue of the plate 15, all the sheets 2 are embedded at the same height, since, as already said, each plate 15 of each sheet 2 corresponds to an abutment element 13 of the centering system 4.

The plate 15 has a predetermined suitable size. The plate is such that the connector 3 has sufficient space to find the optimal position so as to correct the sheets embedding errors. For standard sheets of 60 cm×60 cm (i.e., 2'=60 cm and 2"=60 cm), such plates are 20 cm×20 cm.

The plate 15 is positioned at the corner between the first portion of sheet 2' and the second portion of sheet 2", preferably at the end of the sheet 2 in which the first slotted holes 6 are obtained, so as to be underneath (below) the latter, on completion of assembly.

Figure 6:
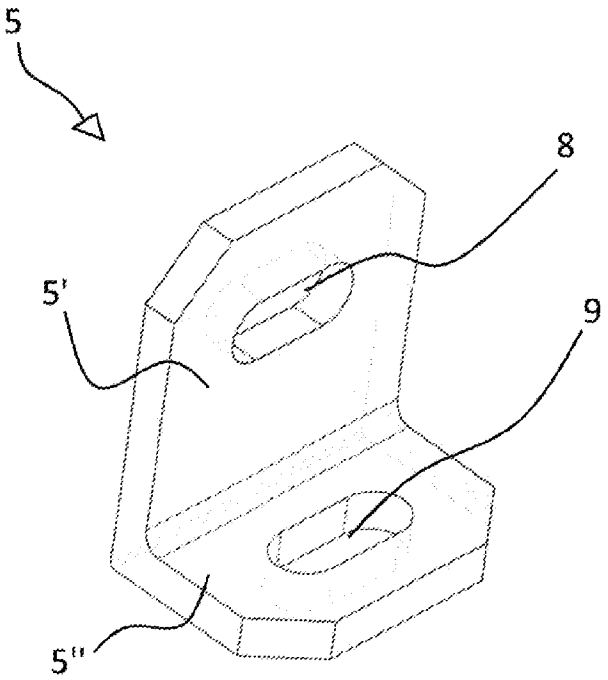
FIG. 6*a* shows a perspective view of a connection element of the kit according to a preferred embodiment of the present invention.

The kit of the present invention also comprises a connector 3, provided with position adjustment means with respect to said connection element 5. Such position adjustment means comprise second slotted holes 7, preferably at least eight, i.e., two for each sheet 2 which the connector 3 is intended to be connected to. In particular, one for each first portion of sheet 2' and one for each second portion of sheet 2". In the preferred embodiment, such second slotted holes 7 are sixteen, two for each first portion of sheet 2' and two for each second portion of sheet 2", as better visible in FIG. 5*b*. They are placed at respective portions of sheet 2', 2" in the assembly position, and are slotted in a direction orthogonal thereto, i.e., each second slotted hole 7 extends orthogonally to the portion of sheet metal with which the connector 3 is intended to be connected, by means of the connection element 5, as shown in FIG. 6.

Furthermore, the kit of the present invention comprises at least one connection element 5 between each sheet 2 and the connector or fitting element 3. In particular, in the preferred embodiment, each sheet 2 is connected to the connector 3 by means of four connection elements 5, i.e., two placed in the first portion of sheet 2' and two placed in the second portion of sheet 2". The connection element 5 preferably comprises a connection bracket of the angular, right angle type, as clearly depicted in FIG. 6. It comprises a first semi-element 5' and a second semi-element 5", orthogonal to each other, and is preferably made of steel, or another type of metal alloy, or metal.

According to the present invention, each connection element 5 is provided with first position adjustment means, adapted to adjust the position thereof with respect to the sheet 2 and second position adjustment means, adapted to adjust the position thereof with respect to the connector 3. The first position adjustment means are arranged on the first semi-element 5', and comprise at least one third slotted hole 8, while the second position adjustment means are placed on the second semi-element 5", and comprise at least one fourth slotted hole 9. The third slotted holes 8 and the fourth slotted holes 9 extend along the same direction perpendicular to the direction of extension of the first slotted holes 6 and of the second slotted holes 7, on completion of assembly.

As mentioned above, the slotting of the holes (first slotted holes 6, second slotted holes 7, third slotted holes 8 and fourth slotted holes 9), can have different directions, i.e., such holes can extend in different directions from the preferred ones, provided that the direction of extension of each of the first slotted holes 6, the second slotted holes 7 and at least one of the third slotted holes 8 and the fourth slotted holes 9 is orthogonal to the direction of extension of the remaining two.

The position adjustment means, in addition to comprising slotted holes, also comprise bolts 24 (FIG. 7*b*) or other connection means of the mechanical type, adapted to be inserted in the respective slotted holes.

In accordance with the present invention, the kit also comprises a centering system 4 for the sheets 2, which can be associated operationally with an embedding machine. It is advantageously adapted to ensure that, on completion of embedding, the positioning errors of each sheet 2 are lower than or equal to the following values: $\Delta x$=70 mm; $\Delta y$=70 mm; $\Delta z$=70 mm; $\Delta\varphi$=5°, with respect to the design data. Even more preferably, $\Delta x$=30 mm; $\Delta y$=30 mm; $\Delta z$=30 mm; $\Delta\varphi$=5°.

Referring to FIGS. 2*a* and 2*b*, preferably the centering system 4 comprises at least one of:

- height adjustment means 10 adapted for the horizontal positioning of the centering system 4 itself;
- guides 11 adapted for the correct positioning of the sheets 2 in the design theoretical embedding position;
- removable elements 12 adapted to create, by means of the removal thereof, before the start of the vibration or percussion operations, a space along at least one axis transverse to the sheet 2 so that the sheet 2 can vibrate or incline at the time of embedding;
- at least one abutment element 13 for each sheet 2 adapted to adjust the embedding height of the sheet 2 itself;
- a central hole 14, adapted to identify a predetermined design point, for the positioning of the centering system 4 itself.

As better explained below, the removable elements 12 are positioned inside the guides 11, as if they were thicknesses and therefore also act as guides, in the sense that they aid the positioning of the sheets 2 in the design theoretical embedding position.

The abutment element 13 establishes the height of the sheet by intervening on the corner plates 15. It is preferably removable, on completion of embedding, to allow the subsequent extraction, and therefore the removal, of the centering system 4.

As shown, above all in FIGS. 2*a* and 2*b*, the centering system 4 comprises a reticular frame formed by a plurality of metal profiles, preferably of the tubular type, extending along three directions perpendicular to one another. To better understand the following description, reference is made to the Cartesian reference system depicted in FIG. 2*a*.

The reticular frame comprises:

- an outer structure in turn comprising:
  - at least two first outer profiles 16, parallel to each other and extending along a first direction x; at least two second outer profiles 17, parallel to each other and extending along a second direction y, orthogonal to the first direction x; and four third outer profiles 18, parallel to one another and extending along a third direction z, orthogonal to the first two directions;
- and an internal structure comprising:
  - at least one first internal profile 19, parallel to the first outer profiles 16; at least a second internal profile 20, parallel to the second outer profiles 17, said at least one second internal profile 20 being rigidly connected to said first outer profiles 16 at the ends thereof; and eight third internal profiles 21, parallel to the third outer profiles 18.

Said first profiles and said second profiles are placed in the plane xy to form a single-plane structure, which can be single, or repeat itself along the direction z. I.e., the first and second profiles can form a two-plane structure, such as that shown in FIGS. 2*a* and 3*a*, or a multi-plane structure, formed by a plurality of parallel multi-plane structures.

Figure 2C:
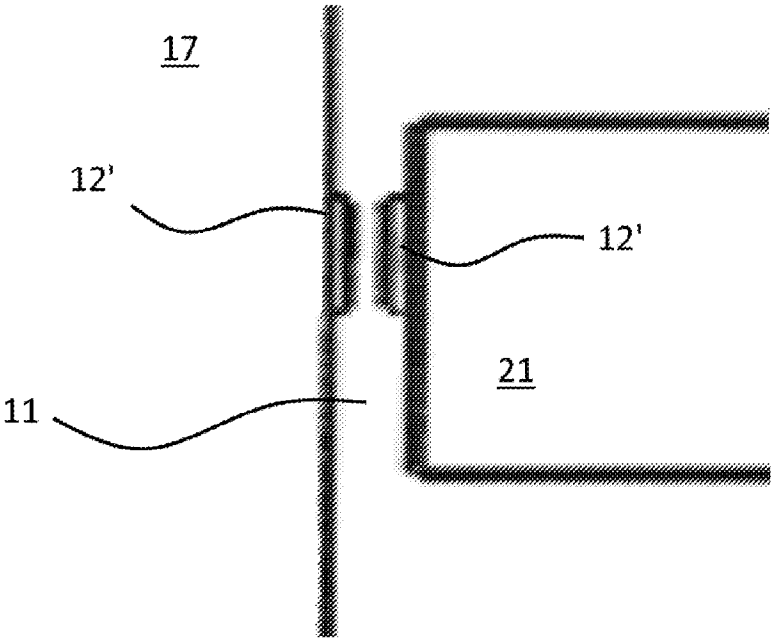
FIG. 2*c* shows an enlarged detail of FIG. 2*b;*

Preferably, the guides 11 are empty spaces obtained between the outer structure and the internal structure, as shown in FIG. 2*b* and, in greater detail, in FIG. 2*c*. They act as a guide for the insertion of the sheets 2 in the centering system 4, as explained below.

At least two removable elements 12 for each sheet 2 to be embedded are placed inside said spaces, or inside said guides 11. Such removable elements 12 are adapted to lock the sheets 2 in the embedding position, before the embedding thereof, so that the positioning thereof is correct, i.e., so that $\Delta x=\Delta y=\Delta\varphi=0$, and to be removed at the time of embedding, to allow the embedding operation itself.

According to preferred embodiments, each element 12 comprises two semi-parts 12', each of which is arranged on the opposite side with respect to the sheet 2, once positioned, as shown in FIG. 3*b* and, in greater detail, in FIG. 3*c*. Such semi-parts 12' are preferably of the magnetic type, so as to be easily applied and easily removed from the metal profiles.

In accordance with the preferred embodiment, the height adjustment means 10 comprise further profiles 22, telescopically coupled to the third internal profiles 21 and/or to the third outer profiles 18, and provided with further holes 23, as shown in FIG. 2*a*. The latter serve to lock the further profiles 22 in position by means of pins or equivalent elements.

The present invention also relates to a method for manufacturing foundations for uprights 1 by using metal sheets 2.

Such method comprises a step a) of arranging at least two sheets 2, in which each sheet 2 is provided with position adjustment means with respect to a connection element 5 between the sheet 2 itself and a connector 3 between the sheet 2 and upright 1.

The method further provides a step b) of arranging a connector 3 between the sheet 2 and upright 1, adapted to be integrally connected to said upright 1 and provided with position adjustment means with respect to a connection element 5 between the sheet 2 and the connector 3 itself.

In accordance with a step c), the method provides to also arrange at least one connection element 5 between each sheet 2 and the connector 3, wherein each connection element 5 is provided with first position adjustment means, adapted to adjust the position thereof with respect to the sheet 2 and second position adjustment means, adapted to adjust the position thereof with respect to the connector 3.

Step d) of the method provides for arranging a centering system 4, which can be associated operationally with an embedding machine.

The sheets 2, the connector 3, the centering system 4, the connection elements 5 and the relative position adjustment means have been previously described and will therefore not be further detailed.

Once the aforesaid components have been arranged, the method provides, in accordance with a step e), to embed said sheets 2 into the ground by vibro-embedding or by percussion, with the aid of the aforesaid centering system 4.

In particular, such step e) is actuated by means of the following sub steps:

- e1. positioning the centering system 4 on the ground, preferably by positioning a central hole 14 of the centering system 4 at a predetermined design point;
- e2. placing the centering system 4 in a horizontal position by means of appropriate height adjustment means 10;
- e3. inserting the sheets 2 in appropriate guides 11 of the centering system 4 so that they are in the theoretical embedding position;
- e4. creating a space along at least one axis transverse to the sheet 2 so that the sheet 2 can vibrate or incline during the successive embedding step;
- e5. embedding the sheets 2 in the ground by means of vibro-embedding or embedding by percussion until reaching a predetermined embedding height;
- e6. removing the centering system 4.

In accordance with preferred embodiments, step e4) of creating spaces is actuated by removing specific removable elements 12, positioned inside the guides 11.

Once the sheets 2 are embedded, the method of the invention provides for a step f) of positioning the connector 3 in the assembly position, i.e., in a position such that the upright 1 is in the design position, adjusting the relative position between:

- each sheet 2 and each connection element 5 by means of said position adjustment means of the sheet 2 and said first position adjustment means of the connection element 5;
- each connection element 5 and the connector 3 by means of said position adjustment means of the connector 3 and said second position adjustment means of the connection element 5.

Finally, the method provides for a step g) of locking such positions.

In accordance with preferred actuation steps, such step f) of adjusting the relative positions is actuated by means of the following sub steps:

- f'. adjusting the relative position between one sheet 2 and a connection element 5 along a first and a second axis, orthogonal to each other;
- f''. adjusting the relative position between said first connection element 5 and the connector 3 along said first or said second axis and along a third axis, orthogonal to the first and to the second axis;
- f'''. repeating steps f' and f'' for each connection element 5 and for each sheet.

Steps f' and f'' are actuated by sliding a bolt 24 inside the aforementioned slotted holes, as it will be better explained below.

Thereby, the adjustment is accurate and the uprights 1, subsequently anchored to the connector 3, are well positioned.

Since each connection element 5 is independent and since it is provided with third slotted holes 8 and fourth slotted holes 9, which collaborate with the first slotted holes 6 of the sheet 2 and the second slotted holes 7 of the connector 3, it is possible to adjust the positions independently along the axes x, y, z.

Since the centering system 4 limits the embedding errors within predetermined intervals, and since such intervals are compatible with the size of the slots of the position adjustment means (slotted holes 6, 7, 8, 9), whatever the position of the connector 3 is following the positioning of the upright 1 as per the design, it is possible to make the connection between the connector 3 and the sheets 2.

The present invention, in a further aspect thereof, relates to a centering system 4 for sheets 2 adapted to be embedded by vibration or percussion, comprising:

- height adjustment means 10 adapted for the horizontal positioning thereof;
- guides 11 adapted for the correct positioning of the sheets 2 in the embedding position;

removable elements 12, placed inside said guides 11, adapted to create a space along at least one axis transverse to the sheet 2 so that the sheet 2 can vibrate or incline.

Preferably, the centering system 4 also comprises at least one abutment element 13 for each sheet 2 adapted to adjust the embedding height of the sheet 2 itself; a central hole 14, adapted to identify a predetermined design point, for the positioning of the centering system 4 itself and/or means for the operational association thereof with an embedding machine by vibration or by percussion.

The abutment element 13 homogenizes the embedding heights of all sheets 2, being present on all sheets 2.

The centering system 4 allows to embed sheets 2, by vibration or percussion, with a positioning error within acceptable limits and therefore allows to extend the field of application of the sheets 2 themselves embedded by vibration or percussion, as mentioned above.

In particular, the centering system is preferably adapted to ensure that, on completion of embedding, the positioning errors of each sheet 2 are lower than or equal to the following values: $\Delta x=70$ mm; $\Delta y=70$ mm; $\Delta z=70$ mm; $\Delta\varphi=5°$, with respect to the design data. Even more preferably, $\Delta x=30$ mm; $\Delta y=30$ mm; $\Delta z=30$ mm; $\Delta\varphi=5°$. Thereby, it is possible to have slottings which are less extended.

A method will now be described for manufacturing foundations for uprights 1 by using sheets 2 embedded by vibration or by percussion, in accordance with a preferred embodiment of the present invention, the method comprising using a centering system 4 and a kit according to preferred embodiments of the present invention.

Figure 7B:
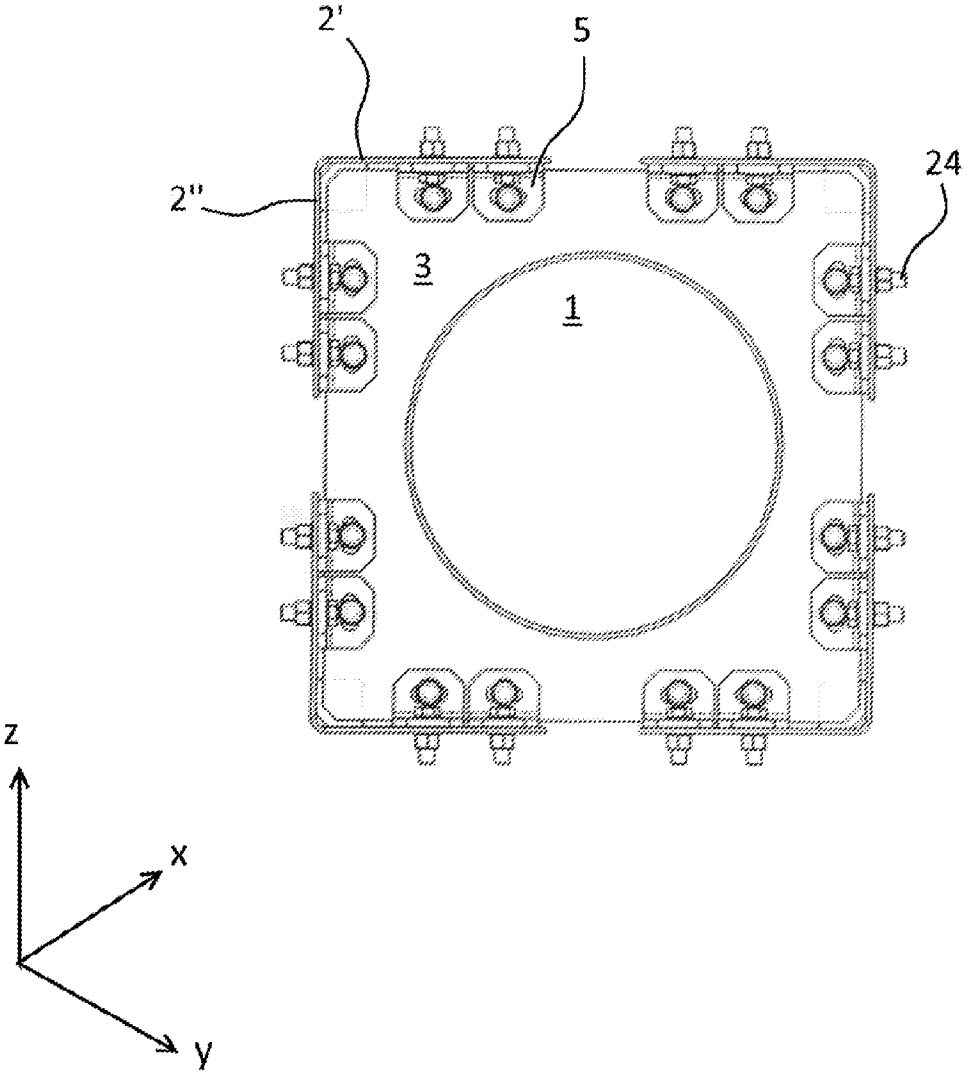
FIG. 7*b* shows a plan view of FIG. 7*a*.
Figure 7A:
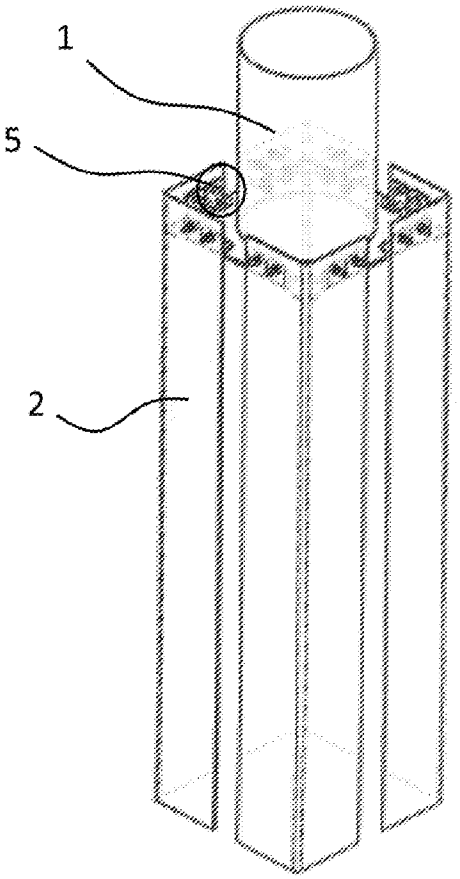
FIG. 7*a* shows a diagrammatic perspective view of the sheets of FIGS. 1*a* and 1*b* connected to the fitting element of FIG. 4 by means of connection elements of FIG. 6, in a final step of the method of the present invention.

For manufacturing foundations for an upright 1, by means of embedding by vibration or by percussion four L-section sheets 2, it is necessary to embed such sheets 2 with errors checked along the three directions x, y and z indicated in FIGS. 2*a* and 7*a*.

To this end, it is necessary to identify a point P on the ground which corresponds to the center of the section of the upright 1, once installed, i.e., to the point of intersection of the design vertical axis with the ground.

Then, the centering system 4 is placed on the ground, so that the central hole 14 thereof corresponds to said point P and, consequently, the axis thereof corresponds to the design axis. Subsequently, the first profiles (outer 16 and internal 19) and the second profiles (outer 17 and internal 20) are arranged so as to be parallel to the two further design axes.

At this point, the height adjustment means 10 are activated, i.e., four further profiles 22 are telescopically slid into the corresponding four third outer vertical profiles 18, so as to make the centering system 4 horizontal, compensating for any slopes or unevenness of the ground. Such position is locked by means of suitable pins, or other locking means, inserted in further holes 23 of the further profiles 22. Subsequently, the four sheets 2 are positioned at the respective guides 11 of the centering system 4. Thereby, by virtue of the presence of the removable elements 12 which facilitate the positioning thereof, they are in the design position, i.e., in the position where $\Delta x=\Delta y=0$ and $\Delta\varphi=0°$. Such positioning is ensured by the fact that the centering system 4 has been appropriately positioned.

At this point, an embedding machine is operatively connected to the sheets 2, at the upper ends thereof. The removable elements 12 are removed to leave enough space for the sheets to vibrate (in the case of vibro-embedding) or to incline (in the case of embedding by percussion).

If the sheets 2 have a thickness of 10 mm, guides 11, equal to about 70 mm, and removable elements 12, overall equal to about 60 mm, i.e., removable semi-parts 12' of about 30 mm each, may be obtained. Thereby, having removed the removable elements 12, the sheets 2 may have about 60 mm of play to ensure the correct completion of the embedding operation.

The sheets 2 are embedded until the plates 15 of the sheet 2 abut against the corresponding abutment elements 13 of the centering system 4, suitably positioned, so as to adjust the embedding height of the sheets 2 and thus homogenize the embedding height of the sheets 2 (step e).

Thereby, $\Delta z$ is substantially equal to zero.

At the end of such step, the sheets 2 are in the position shown in FIG. 3*a*, where, for reasons of clarity, the ground has been omitted.

The centering system 4 can therefore be removed, for example, by dismantling the abutment elements 13.

Figure 5B:
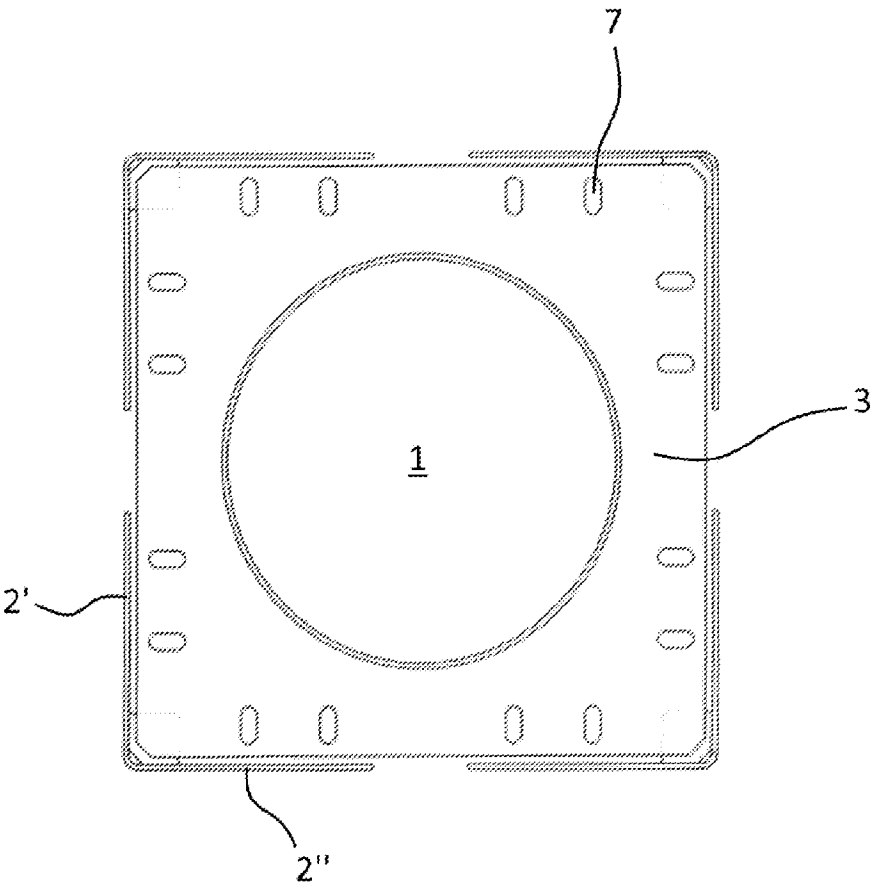
FIG. 5*b* shows a plan view of FIG. 5*a;*
Figure 5A:
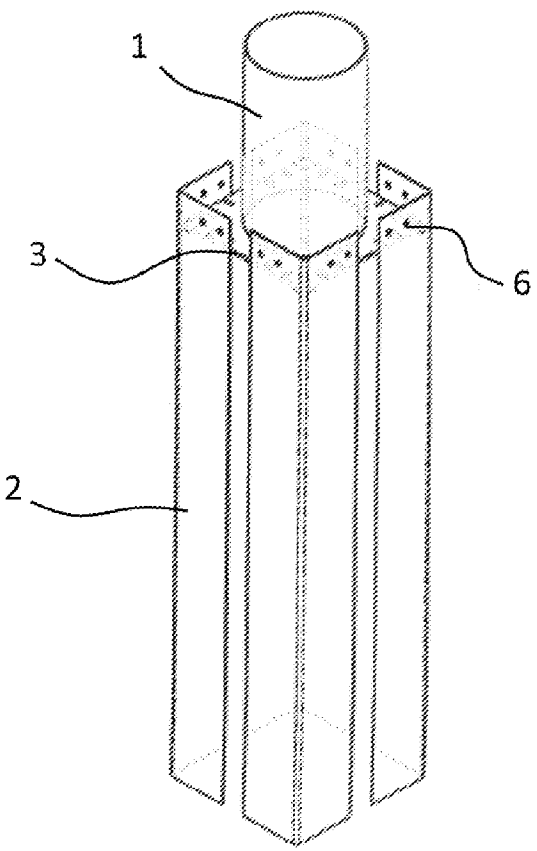
FIG. 5*a* shows a diagrammatic perspective view of the sheets of FIGS. 1*a* and 1*b* and of the connector of FIG. 4, during a step of the method of the present invention.

At this point, the connector 3, on which the upright 1, or the connector 3 already made integral with the upright 1, will subsequently be integrally anchored, as shown in FIG. 4, is resting on the plates 15 of the sheets 2, as shown in FIG. 5*a*, in a position such that the upright 1 is in the design position thereof.

At this moment, step f) of fine adjusting the positioning of the connector 3 begins. The connection elements 5, by means of the position adjustment means, find their fastening seat in the sheets 2 and in the connector 3 by virtue of the fact that the embedding errors were previously contained within predetermined intervals.

The relative position between a sheet 2 and the connection element 5 shown in FIG. 7*a*, is adjusted along the direction z of the reference system of FIG. 7*a*, or along the vertical direction, by sliding a bolt 24 through the corresponding first slotted hole 6 of the sheet 2, and along the direction x of the same reference system, through the third slotted hole 8 of the connection element 5 (step f').

The relative position between the same connection element 5 and the connector 3 is adjusted along the direction x of the same reference system, by sliding a bolt 24 through the fourth slotted hole 9 of the connection element 5 and, along the direction y of the same reference system, through the second slotted hole 7 of the connector 3 (step f").

Once the design positions have been found, following the position of the connector 3 which is the position such that the upright 1 is in the design position, these are locked by closing the bolt 24, for example, by screwing a nut. (step g)

Steps f' and f" are repeated for each connection element 5 and therefore for each sheet 2 (step f'"), obtaining an upright 1 correctly placed in the design position.

In accordance with preferred embodiments, with sheets 2 having a size of 60 cm×60 cm, the errors are equal to or lower than 30 mm along each direction, i.e., $\Delta x=30$ mm; $\Delta y=30$ mm; $\Delta z=30$ mm, so as to be canceled with slots of about 60 mm (the nut diameter, usually equal to 20 mm, must be added to such value).

In any case, the sizing of sheets 2, connector 3, connection elements 5, guides 11, removable elements 12, slotted holes 6, 7, 8, 9, and therefore of the allowed deviations ($\Delta x$, $\Delta y$, $\Delta z$ and $\Delta\varphi$), with respect to the design data, depend on the size of the upright 1 and the use for which it is intended.

The present invention has been described herein with reference to preferred embodiments thereof, but it is understood that equivalent modifications may be made without departing from the scope of the protection afforded thereto.

Consequently, the scope of protection of the present invention must not be limited to the embodiments described only by way of explanation but must be considered on the basis of the appended claims.

The invention claimed is:

1. A method for installing a foundation for an upright by using metal sheets embedded by vibration or by percussion, the method comprising the steps of:

a. arranging at least two sheets lateral to the upright, the upright being integral with a connector and the connector being positioned between the at least two sheets and the upright, each sheet being provided with a first position adjustment means with respect to one or more connection elements, each connection element being positioned between one of the at least two sheets and the connector of the upright;

b. arranging the connector of the upright with a second position adjustment means with respect to each of the one or more connection elements which are positioned between one of the at least two sheets and the connector of the upright;

c. arranging each of the one or more connection elements between one of the at least two sheets and the connector, each connection element being provided with a third position adjustment means that is arranged to adjust positioning thereof with respect to a respective one of the at least two sheets, and a fourth position adjustment means that is arranged to adjust positioning thereof with respect to the connector of the upright;

d. arranging a centering system for the at least two sheets, which is associated operationally with an embedding machine;

e. embedding said at least two sheets into the ground by vibro-embedding or percussion using the centering system;

f. positioning the connector of the upright in a predetermined design configuration and adjusting relative positions between:

each of the at least two sheets and each connection element by said first position adjustment means of each sheet and said third position adjustment means of each connection element; and each connection element and the connector of the upright by said second position adjustment means of the connector of the upright and said fourth position adjustment means of each connection element; and g. locking the first and third position adjustment means and the second and fourth position adjustment means.

2. The method according to claim 1, wherein step f) of adjusting the relative positions includes the steps of:

f'. adjusting relative positioning between one of the at least two sheets and a corresponding one or more first connection elements along a first axis and a second axis which are orthogonal to each other;

f''. adjusting relative positioning between said corresponding one or more first connection elements and the connector of the upright along said first axis or said second axis and along a third axis, which is orthogonal to the first axis and to the second axis; and f'''. repeating steps f') and f'') for each connection element and for each sheet.

3. The method according to claim 1, wherein said centering system is arranged such that, on completion of embedding, positioning errors of each sheet are lower than or equal to the following values: $\Delta x=70$ mm; $\Delta y=70$ mm; $\Delta z=70$ mm; $\Delta\varphi=5°$, with respect to the predetermined design configuration.

4. The method according to claim 1, wherein step f) is adapted to ensure that positioning errors of the upright are substantially equal to zero with respect to the predetermined design configuration.

5. The method according to claim 1, wherein step e) of embedding the at least two sheets in the ground includes the steps of:

e1. positioning the centering system on the ground;

e2. placing the centering system in a horizontal position using a height adjustment means;

e3. inserting the at least two sheets in appropriate guides of the centering system so that the at least two sheets are in an embedding position;

e4. creating a space along at least one axis transverse to each sheet so that each sheet can vibrate or incline during successive sheet embedding steps;

e5. embedding the at least two sheets in the ground by means of vibro-embedding or embedding by percussion until reaching a predetermined embedding height; and e6. removing the centering system.

6. A kit for installing a foundation for an upright by using sheets embedded by vibration or by percussion, the kit comprising:

at least two sheets lateral to the upright, the upright being integral with a connector and the connector being positioned between the at least two sheets and the upright, each of the at least two sheets being provided with a first position adjustment means with respect to one or more connection elements, each connection element being positioned between one of the at least two sheets and the connector of the upright;

the connector with a second position adjustment means with respect to each of the one or more connection elements which are positioned between one of the at least two sheets and the connector of the upright;

the one or more connection elements between each of the at least two sheets and the connector of the upright, each connection element being provided with a third position adjustment means that is arranged to adjust positioning thereof with respect to one of the at least two sheets, and a fourth position adjustment means that is arranged to adjust positioning thereof with respect to the connector of the upright; and a centering system for the at least two sheets, which is associated operationally with an embedding machine.

7. The kit according to claim 6, wherein said centering system is arranged such that, on completion of embedding, positioning errors of each sheet are lower than or equal to the following values: $\Delta x=70$ mm; $\Delta y=70$ mm; $\Delta z=70$ mm; $\Delta\varphi=5°$, with respect to a predetermined design configuration.

8. The kit according to claim 6, wherein said centering system comprises at least one of:

height adjustment means configured for horizontal positioning of the centering system;

guides configured for positioning of the at least two sheets in an embedding position;

removable elements to create, by means of removal thereof, a space along at least one axis transverse to each sheet so that each sheet can vibrate or incline during time of embedding;

at least one abutment element for each sheet configured to adjust embedding height of each sheet;

a central hole adapted to identify a predetermined design point for positioning of the centering system.

9. The kit according to claim 6, wherein said centering system comprises a reticular frame formed by a plurality of metal profiles extending along three directions perpendicular to one another.

10. The kit according to claim 9 wherein said reticular frame comprises:

an outer structure comprising:

at least two first outer profiles, parallel to each other and extending along a first direction (x); at least two second outer profiles, parallel to each other and extending along a second direction (y), orthogonal to the first direction (x); and four third outer profiles, parallel to one another and extending along a third direction (z), orthogonal to the first and second directions; and an internal structure comprising:

at least one first internal profile, parallel to the first outer profiles; at least a second internal profile, parallel to the second outer profiles, said at least one second internal profile rigidly connected to said first outer profiles at opposing ends thereof; and eight third internal profiles, parallel to the third outer profiles.

11. The kit according to claim 10, wherein, between the outer structure and the internal structure, spaces are obtained acting as a guide for insertion of the at least two sheets in the centering system.

12. The kit according to claim 11, wherein at least one removable element is placed inside each of said spaces for each sheet, the at least one removable element arranged to lock the at least two sheets in the embedding position and be removed at a time of embedding.

13. The kit according to claim 6, wherein at least one of the first, second, third and fourth position adjustment means include slotted holes.

14. The kit according to claim 6, wherein each of said one or more connection elements comprises an angular-type connection bracket.

* * * * *